US006143091A

United States Patent [19]

Saito et al.

[11] Patent Number: 6,143,091

[45] Date of Patent: Nov. 7, 2000

[54] METHOD FOR REMOVING A SUBSTANCE DEPOSITED ON A SHEET

[75] Inventors: Masatoshi Saito, Tokyo; Tooru Maruyama, Fujisawa; Hisao Watanabe, Sagamihara, all of Japan

[73] Assignee: Ricoh Company, Ltd., Tokyo, Japan

[21] Appl. No.: 09/154,497

[22] Filed: Sep. 17, 1998

Related U.S. Application Data

[62] Division of application No. 08/869,970, Jun. 5, 1997, Pat. No. 5,855,734, which is a division of application No. 08/542,905, Oct. 13, 1995, Pat. No. 5,735,009.

[30] Foreign Application Priority Data

Oct. 14, 1994 [JP] Japan ..... 6-275913
Sep. 11, 1995 [JP] Japan ..... 7-259280

[51] Int. Cl.[7] ..... B08B 1/02

[52] U.S. Cl. ..... 134/9; 134/6; 134/15; 134/32

[58] Field of Search ..... 134/9, 15, 6, 32

[56] References Cited

U.S. PATENT DOCUMENTS 207,626 9/1878 Sargent .
722,252 3/1903 Richards .

(List continued on next page.)

FOREIGN PATENT DOCUMENTS 50-56942 5/1975 Japan .
51-100728 9/1976 Japan .
54-27435 3/1979 Japan .
54-99353 8/1979 Japan .
55-30500 3/1980 Japan .
55-154198 12/1980 Japan .
57-114171 7/1982 Japan .
57-125962 8/1982 Japan .
57-125963 8/1982 Japan .
57-190675 11/1982 Japan .
58-105569 7/1983 Japan .
59-2069 1/1984 Japan .
59-33483 2/1984 Japan .
59-89372 5/1984 Japan .
59-93764 5/1984 Japan .

(List continued on next page.)

OTHER PUBLICATIONS

Encyclopedia of Chemical Technology, vol. 6, pp. 386–426, 1979, Stanley C. Zink, "Coating Processes".

*Primary Examiner*—Zeinab El-Arini
*Attorney, Agent, or Firm*—Oblon, Spivak, McClelland, Maier & Neustadt, P.C.

[57] ABSTRACT

In a method for removing toner or similar substance deposited on a recording sheet or similar sheet, projections are formed on a back-up member and located at portions on which the rear of a separating member slide. While a sheet is passed through a pressing portion in contact with the separating member, the projections raise the rear of the separating member toward the surface of the sheet carrying the toner. Hence, even solitary particles of the substance adjoining relatively thick and large masses of the substance can contact the front of the separating member. Hence, the solitary particles are prevented from remaining on the sheet.

4 Claims, 8 Drawing Sheets

U.S. PATENT DOCUMENTS

| | | | |
|---|---|---|---|
| 1,947,748 | 2/1934 | Van Wormer . | |
| 2,207,966 | 7/1940 | Billings, Jr. . | |
| 2,831,409 | 4/1958 | Bixby et al. . | |
| 2,937,390 | 5/1960 | Bolton et al. | 15/3 |
| 3,069,013 | 12/1962 | Neubrech et al. . | |
| 3,108,895 | 10/1963 | Howell . | |
| 3,202,532 | 8/1965 | Labombarde . | |
| 3,230,305 | 1/1966 | Kendrick . | |
| 3,237,231 | 3/1966 | Zink | 15/102 |
| 3,328,821 | 7/1967 | La Mura | 15/102 |
| 3,448,720 | 6/1969 | Graham . | |
| 3,598,487 | 8/1971 | Mizuguchi et al. . | |
| 3,613,701 | 10/1971 | Ando . | |
| 3,630,776 | 12/1971 | Barr | 134/9 |
| 3,656,948 | 4/1972 | Mammino . | |
| 3,776,381 | 12/1973 | Wood . | |
| 3,776,631 | 12/1973 | Mammino . | |
| 3,945,079 | 3/1976 | Westberg . | |
| 3,998,329 | 12/1976 | Araya et al. . | |
| 4,010,514 | 3/1977 | Fischer et al. . | |
| 4,204,865 | 5/1980 | Kuehnle et al. . | |
| 4,249,653 | 2/1981 | Kufferath-Kassner . | |
| 4,252,882 | 2/1981 | Herrmann . | |
| 4,273,438 | 6/1981 | Nishikawa . | |
| 4,344,539 | 8/1982 | Lockett . | |
| 4,388,391 | 6/1983 | Schell . | |
| 4,392,742 | 7/1983 | Landa . | |
| 4,482,241 | 11/1984 | Moraw et al. . | |
| 4,504,995 | 3/1985 | Zippwald, Sr. . | |
| 4,733,422 | 3/1988 | Schramm et al. . | |
| 4,740,075 | 4/1988 | Schoernig . | |
| 4,764,447 | 8/1988 | Tsubuko et al. . | |
| 4,799,596 | 1/1989 | Mallant . | |
| 4,800,839 | 1/1989 | Ariyama et al. . | |
| 4,832,725 | 5/1989 | Noguchi et al. . | |
| 4,899,872 | 2/1990 | Hokao . | |
| 4,905,047 | 2/1990 | Ariyama . | |
| 4,965,640 | 10/1990 | Watarai et al. . | |
| 4,993,700 | 2/1991 | Winkler . | |
| 5,063,411 | 11/1991 | Haneda et al. . | |
| 5,215,852 | 6/1993 | Kato et al. . | |
| 5,244,100 | 9/1993 | Regier et al. . | |
| 5,262,259 | 11/1993 | Chou et al. . | |
| 5,305,893 | 4/1994 | Hereford . | |
| 5,351,834 | 10/1994 | Duss . | |
| 5,353,108 | 10/1994 | Tsukamoto . | |
| 5,359,398 | 10/1994 | Echigo et al. . | |
| 5,652,989 | 8/1997 | Chiba et al. | 15/3 |

FOREIGN PATENT DOCUMENTS

| | | |
|---|---|---|
| 59-98172 | 6/1984 | Japan . |
| 60-59245 | 4/1985 | Japan . |
| 60-133458 | 7/1985 | Japan . |
| 60-182465 | 9/1985 | Japan . |
| 60-193691 | 10/1985 | Japan . |
| 60-230899 | 11/1985 | Japan . |
| 61-213185 | 9/1986 | Japan . |
| 61-237684 | 10/1986 | Japan . |
| 62-14163 | 1/1987 | Japan . |
| 62-102270 | 5/1987 | Japan . |
| 62-203190 | 9/1987 | Japan . |
| 62-212187 | 9/1987 | Japan . |
| 62-199767 | 12/1987 | Japan . |
| 63-39377 | 2/1988 | Japan . |
| 63-73282 | 4/1988 | Japan . |
| 63-140577 | 9/1988 | Japan . |
| 1-101576 | 4/1989 | Japan . |
| 1-101577 | 4/1989 | Japan . |
| 1-137266 | 5/1989 | Japan . |
| 1-145680 | 6/1989 | Japan . |
| 1-297294 | 11/1989 | Japan . |
| 2-11400 | 1/1990 | Japan . |
| 2-3400 | 1/1990 | Japan . |
| 2-3876 | 1/1990 | Japan . |
| 2-19568 | 2/1990 | Japan . |
| 2-55195 | 2/1990 | Japan . |
| 2-59926 | 2/1990 | Japan . |
| 2-62277 | 3/1990 | Japan . |
| 2-111987 | 4/1990 | Japan . |
| 2-58771 | 4/1990 | Japan . |
| 2-188293 | 7/1990 | Japan . |
| 2-188294 | 7/1990 | Japan . |
| 2-117547 | 9/1990 | Japan . |
| 2-227299 | 9/1990 | Japan . |
| 4-118500 | 10/1990 | Japan . |
| 3-116594 | 5/1991 | Japan . |
| 3-218898 | 9/1991 | Japan . |
| 3-249661 | 11/1991 | Japan . |
| 4-22968 | 1/1992 | Japan . |
| 4-57070 | 2/1992 | Japan . |
| 4-64472 | 2/1992 | Japan . |
| 4-64473 | 2/1992 | Japan . |
| 4-67043 | 3/1992 | Japan . |
| 4-82983 | 3/1992 | Japan . |
| 4-89271 | 3/1992 | Japan . |
| 4-91298 | 3/1992 | Japan . |
| 4-126900 | 4/1992 | Japan . |
| 4-234056 | 8/1992 | Japan . |
| 4-118499 | 10/1992 | Japan . |
| 4-281096 | 10/1992 | Japan . |
| 4-300395 | 10/1992 | Japan . |
| 4-301664 | 10/1992 | Japan . |
| 4-327299 | 11/1992 | Japan . |
| 4-333088 | 11/1992 | Japan . |
| 4-333699 | 11/1992 | Japan . |
| 4-356085 | 12/1992 | Japan . |
| 4-356086 | 12/1992 | Japan . |
| 4-356087 | 12/1992 | Japan . |
| 4-356088 | 12/1992 | Japan . |
| 4-356089 | 12/1992 | Japan . |
| 4-362935 | 12/1992 | Japan . |
| 5-2356 | 1/1993 | Japan . |
| 5-32926 | 2/1993 | Japan . |
| 5-61382 | 3/1993 | Japan . |
| 5-127571 | 5/1993 | Japan . |
| 5-148435 | 6/1993 | Japan . |
| 5-173454 | 7/1993 | Japan . |
| 5-197315 | 8/1993 | Japan . |
| 5-216374 | 8/1993 | Japan . |
| 5-216375 | 8/1993 | Japan . |
| 5-216376 | 8/1993 | Japan . |
| 5-221128 | 8/1993 | Japan . |
| 5-232737 | 9/1993 | Japan . |
| 5-232738 | 9/1993 | Japan . |
| 5-246115 | 9/1993 | Japan . |
| 5-297766 | 11/1993 | Japan . |
| 5-323831 | 12/1993 | Japan . |
| 5-323832 | 12/1993 | Japan . |
| 6-11938 | 1/1994 | Japan . |
| 6-19181 | 1/1994 | Japan . |
| 6-8623 | 1/1994 | Japan . |
| 6-8626 | 1/1994 | Japan . |
| 6-13651 | 2/1994 | Japan . |
| 6-13652 | 2/1994 | Japan . |
| 6-27710 | 2/1994 | Japan . |
| 6-27735 | 2/1994 | Japan . |
| 6-27736 | 2/1994 | Japan . |
| 6-27737 | 2/1994 | Japan . |
| 6-27738 | 2/1994 | Japan . |
| 6-27739 | 2/1994 | Japan . |
| 6-43682 | 2/1994 | Japan . |
| 6-51669 | 2/1994 | Japan . |

| | | |
|---|---|---|
| 6-67576 | 3/1994 | Japan . |
| 6-91987 | 4/1994 | Japan . |
| 6-143745 | 5/1994 | Japan . |
| 6-143746 | 5/1994 | Japan . |
| 6-143807 | 5/1994 | Japan . |
| 6-155776 | 6/1994 | Japan . |
| 6-155858 | 6/1994 | Japan . |
| 6-155906 | 6/1994 | Japan . |
| 6-161326 | 6/1994 | Japan . |
| 6-175538 | 6/1994 | Japan . |
| 6-206358 | 7/1994 | Japan . |
| 6-208317 | 7/1994 | Japan . |
| 6-208318 | 7/1994 | Japan . |
| 6-270431 | 9/1994 | Japan . |
| 6-279721 | 10/1994 | Japan . |
| 6-286176 | 10/1994 | Japan . |
| 6-286177 | 10/1994 | Japan . |
| 6-286312 | 10/1994 | Japan . |
| 6-295142 | 10/1994 | Japan . |
| 6-297810 | 10/1994 | Japan . |
| 6-299106 | 10/1994 | Japan . |
| 6-308761 | 11/1994 | Japan . |
| 6-308823 | 11/1994 | Japan . |
| 6-308860 | 11/1994 | Japan . |
| 6-308861 | 11/1994 | Japan . |
| 6-332239 | 12/1994 | Japan . |
| 6-332340 | 12/1994 | Japan . |
| 7-121068 | 5/1995 | Japan . |
| WO 89/03728 | 5/1989 | WIPO . |

METHOD FOR REMOVING A SUBSTANCE DEPOSITED ON A SHEET

This application is a Division of application Ser. No. 08/869,970, filed on Jun. 5, 1997, now U.S. Pat. No. 5,855,734, which is a divisional of application Ser. No. 08/542,905, filed Oct. 13, 1995, now U.S. Pat. No. 5,735,009.

BACKGROUND OF THE INVENTION

The present invention relates to a device for removing a substance deposited on the surface of a sheet and, more particularly, to a device for removing toner or similar image forming substance from the surface of a recording sheet.

A device having the above capability has recently been proposed in order to recycle recording sheets carrying images formed by an electrophotographic copier or similar image forming apparatus. Usually, an image formed on a sheet consists of relatively thick and large masses of toner forming major parts of the image, and fine solitary toner particles spaced from the masses. The conventional device has a problem that because many of the solitary toner particles exist around the edges of the image, a separating member included in the device cannot remove all the solitary particles from the sheet. Another problem is that the separating member cannot be smoothly separated from the sheet and is apt to be damaged.

SUMMARY OF THE INVENTION

It is, therefore, an object of the present invention to provide a device capable of surely removing the entire substance deposited on a sheet.

It is another object of the present invention to provide a device for removing a substance deposited on a sheet, and capable of smoothly separating the sheet from a separating member while causing a minimum of damage to the separating member.

In accordance with the present invention, a device for removing a substance deposited on the surface of a sheet has a separating member for exerting, when brought into contact with the substance on the sheet, an adhering force on the substance, and for separating the substance from the sheet when separated from the sheet. A back-up member backs up the rear of the separating member moving with the sheet contacting it. A pressing member faces the back-up member, and presses the sheet and separating member. Projections are formed on the surface of the back-up member on which the rear of the separating member slides.

Also, in accordance with the present invention, a device for removing a substance deposited on the surface of a sheet has a separating member for exerting, when brought into contact with the substance on the sheet, an adhering force on the substance, and for separating the substance from the sheet when separated from the sheet. A back-up member backs up the rear of the separating member moving with the sheet contacting it. A pressing member faces the back-up member, and presses the sheet and separating member. A moving device causes at least a part of the sheet and at least a part of the separating member, once brought into contact with each other and then separated, to again contact each other, and then moves the sheet and separating member.

Further, in accordance with the present invention, a device for removing a substance deposited on the surface of a sheet has a separating member for exerting, when brought into contact with the substance on the sheet, an adhering force on the substance, and for separating the substance from the sheet when separated from the sheet. The separating member is movable along an endless path with the sheet contacting it. A back-up member backs up the rear of the separating member. A separator roller separates the sheet from the separating member. The back-up member and separator roller are located inside of the endless path and downstream, in the intended direction of sheet transport, of a nip where the sheet and separator roller contact each other. Grooves are formed in the separator roller at predetermined intervals in the axial direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, a brief reference will be made to conventional devices for removing toner or similar image forming substance deposited on a recording sheet, shown in FIGS. 9 and 10.

Figure 9:
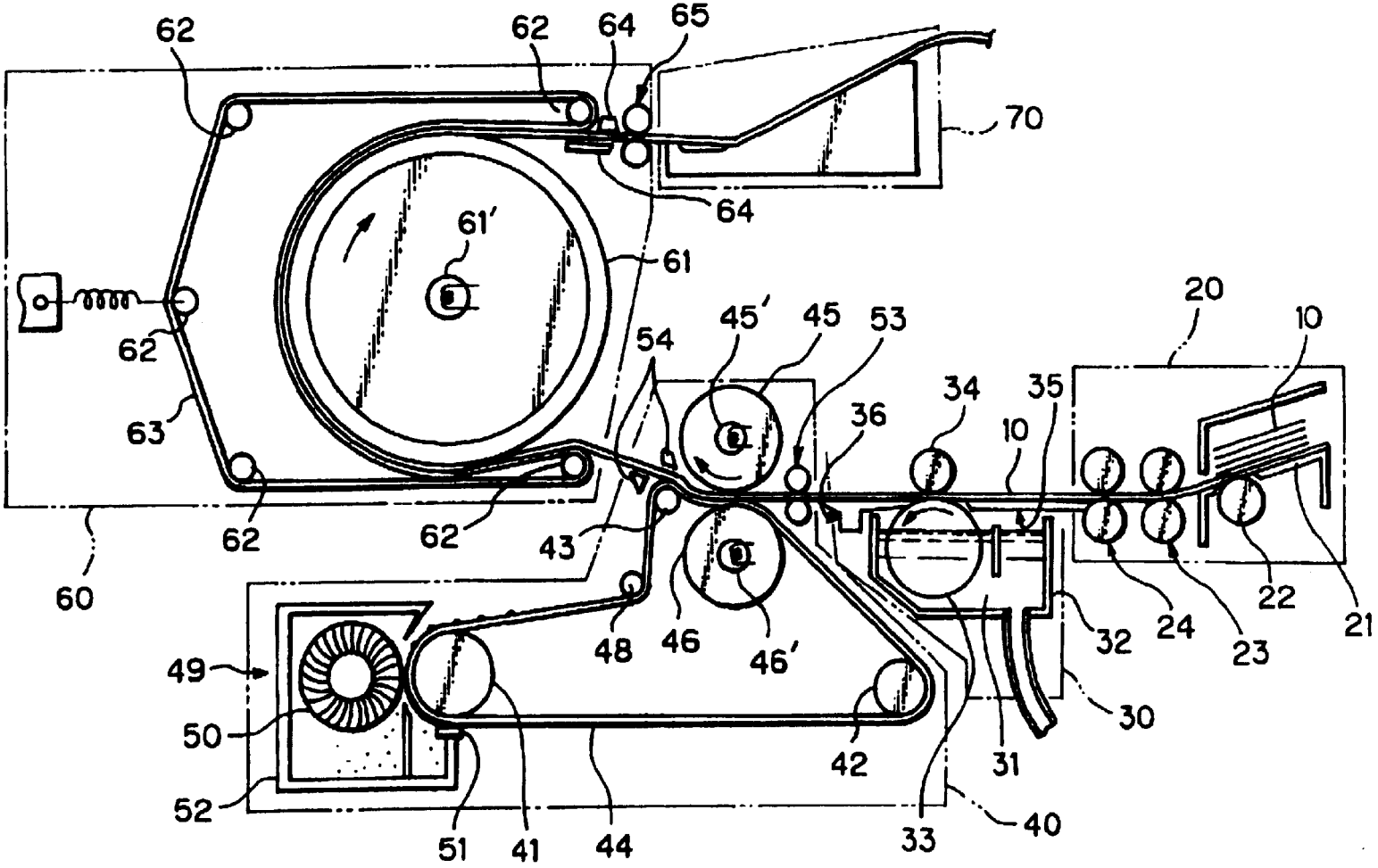
Fig. 9 PRIOR ART
FIGS. 9 and 10 are sections each showing a particular conventional device for removing toner from a sheet.

The device shown in FIG. 9 has a sheet feeding unit 20 accommodating a stack of sheets or recordings 10 each carrying a toner image thereon. The sheets 10 are fed from the unit 20 one by one. A liquid applying unit 30 applies a parting liquid to the sheet 10 fed from the unit 20. A toner separating unit, or separating means, 40 separates the toner from the sheet 10 come out of the liquid applying unit 30.

A drying unit 60 dries the sheet 10 from which the toner has been separated by the separating unit 40. The sheet 10 coming out of the drying unit 60 is driven out to a tray unit 70.

In operation, when the sheet 10 from the feeding unit 20 is introduced into the liquid applying unit 30, the unit 30 applies the parting liquid evenly over the entire surface of the sheet 10 on which a toner image is carried. Let this surface be referred to an image surface hereinafter. Then, the sheet 10 is conveyed into the toner separating unit 40. The unit 40 softens the toner deposited on the sheet 10 with a heat roller 45 and a support member 46. The support member or back-up member 46 supports a belt or toner separating member 44. As a result, the toner softened on the sheet 10 adheres to the surface of the belt 44. When the sheet 10 is separated from the belt 44 by a separator roller 43, the toner is transferred from the sheet 10 to the belt 44.

Figure 10:
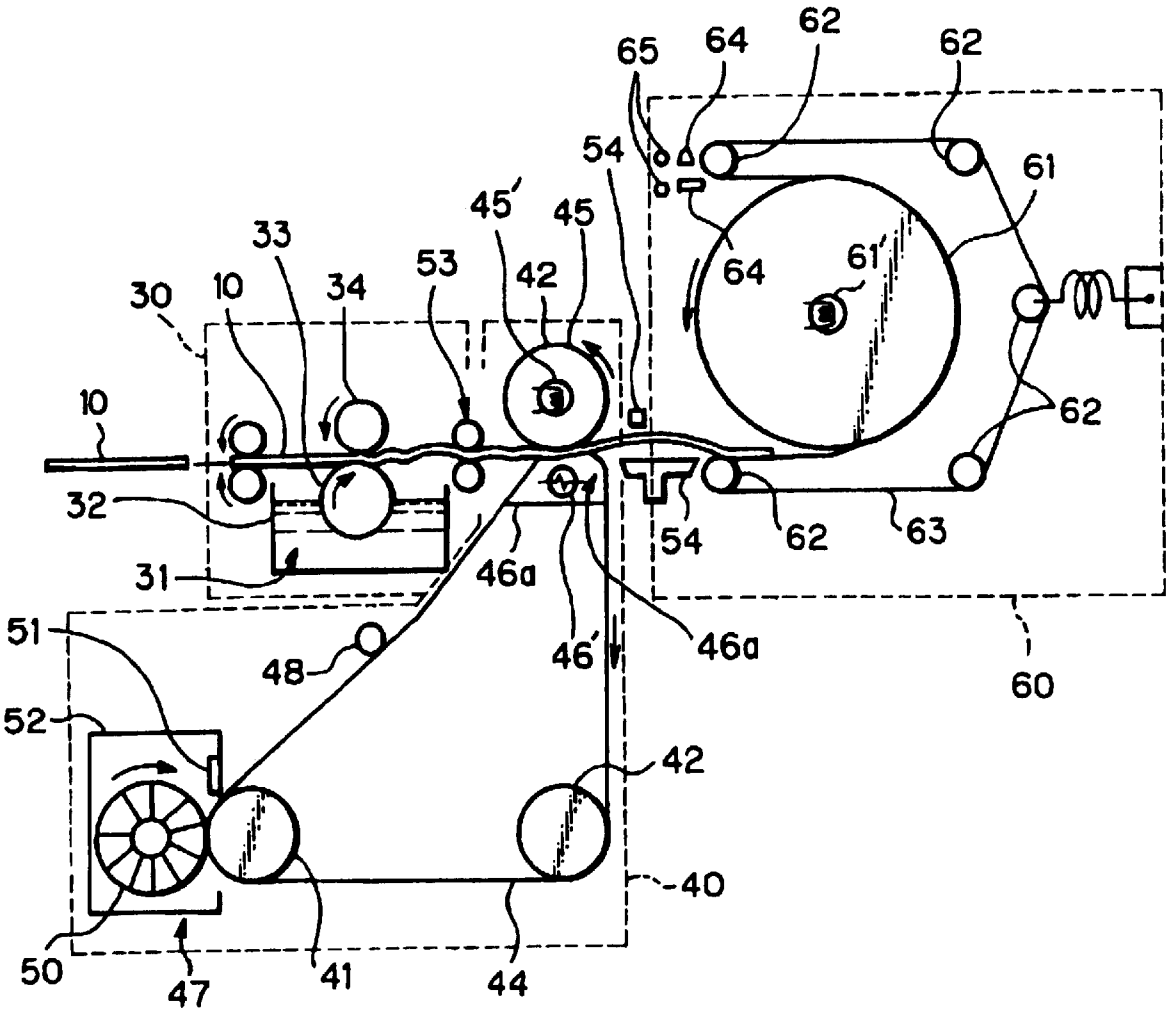
Fig. 10 PRIOR ART

The device shown in FIG. 10 has a heat block 46*a* in place of the back-up member 46. The function of the separator roller 43, FIG. 9, is assigned to one corner 46'*a* of the heat block 46*a* positioned at the downstream side in the intended direction of sheet feed. As to the rest of the construction, the device of FIG. 10 is similar to the device of FIG. 9. The sheet feeding unit 20 and tray unit 70 are not shown in FIG. 10.

Figure 11:
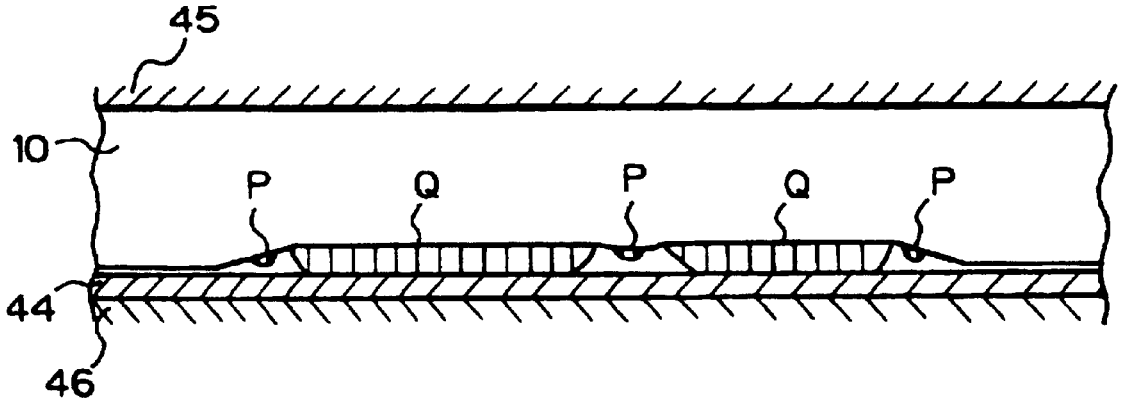
Fig. 11 PRIOR ART
FIG. 11 is a sketch showing how solitary toners and a belt contact at a nip included in any of the conventional devices.

Generally, an image formed on a sheet by a copier using dry toner is constituted by toner particles having a particle size of several microns to 10 and some microns. Such toner is transferred to and fixed on the sheet in substantially a single layer. The image is made up of relatively thick and large masses of toner particles forming the major parts of the image, and small solitary toner particles spaced apart from the masses, as stated earlier. Many of the solitary particles exist around the edges of the image. With the device shown in FIGS. 9 or 10, it is likely that the solitary particles on the sheet 10 fail to closely contact the belt 44 and, as a result, remain on the sheet 10. Specifically, as shown in FIG. 11, assume that solitary particles P adjoin relatively thick masses of toner particles Q. Then, when the sheet 10 is passed through the separating unit 40, the masses Q support the sheet 10 and prevent the particles P from contacting the belt 44.

As shown in FIG. 10, the portion for separating the sheet 10 from the belt 44 is implemented by the corner 46'*a* of the heat block 46*a* downstream of a nip between the block 46*a* and the heat roller 45. The corner 46'*a* sharply changes the direction in which the belt 44 runs, thereby separating the sheet 10 from the belt 44 on the basis of curvature. However, if the adhesion acting between the belt 44 and the sheet 10 is increased in order to enhance the efficient separation of the masses Q, FIG. 11, it is likely that the belt 44 and sheet 10 fail to separate from each other. Moreover, when the moving direction of the belt 44 is changed more sharply by the corner 46'*a,* a greater frictional force acts on the belt 44. As a result, a load to act on drive means for driving the belt 44 increases and thereby scales up the driving means. In addition, an excessive force is apt to act on the belt 44 at the corner 46'*a* and damage it.

The present invention capable of obviating the above problems particular to the conventional devices will be described hereinafter. The present invention is implemented as a device for removing toner deposited on a sheet by an electrophotographic copier by way of example. For the following description, a reference will be made to FIG. 9 except for the characteristic features of the present invention.

Basically, the toner removing device is made up of the various units shown in FIG. 9, i.e., sheet feeding unit 20, liquid applying unit 30, separating unit 40, drying unit 60, and tray unit 70. The sheets 10 are stacked on a tray 21 included in the sheet feeding unit 20 face down, i.e., their image surfaces facing downward. A pick-up roller 22 feeds the lowermost sheet 10 out of the unit 20. At this instant, a separator roller pair 23 separates the lowermost sheet 10 from the overlying sheets 10, so that only the lowermost sheet 10 is fed out by a feed roller pair 24. The construction and operation of the unit 20 is substantially identical with those of a sheet feed unit customarily included in an electrophotographic copier and will not be described specifically.

The liquid applying unit 30 applies to the sheet 10 a parting liquid 31 which may be water or an aqueous solution containing a surfactant. The surfactant promotes the permeation of the liquid into the sheet 10. The unit 30 has a vessel 32 filled with the liquid 31, an applicator roller 33 partly immersed in the liquid 31 and rotatable for applying the liquid 31 to the image surface of the sheet 10, and a regulator roller, or sheet regulating member, 34 facing the applicator roller 33 with the intermediary of a sheet transport path. The applicator roller 33 may be formed of a hydrophilic porous material, sponge or similar material capable of retaining a liquid therein, or rubber similar elastic material, or metal or similar rigid material. A first sheet guide mechanism 35 guides the sheet 10 fed from the unit 20 to the nip between the applicator roller 33 and the regulator roller 34. The nip will be referred to as a liquid applying position hereinafter. A second sheet guide mechanism 36 guides the sheet 10 coming out of the liquid applying position to the toner separating unit 40.

The toner separating unit 40 has a plurality of support rollers 41, 42 and 43 over which the belt 44 is passed, the heat roller 45 and back-up member 46 respectively accommodating lamps or heaters 45' and 46', and a belt cleaning device 49 for removing the toner from the surface of the belt 44. At least the surface of the belt 44 is made of a material causing the softened toner to adhere thereto more intensely than to the surface of the sheet 10. For example, the entire belt 44 is formed of aluminum-, copper- or nickel-based metal, or polyethylene terephthalate (PET) in which titanium oxide is dispersed or similar material having a high molecular weight.

The part of the belt 44 coming out of the nip between the heat roller 45 and the back-up roller 46 is passed over the support roller, or separator roller as referred to hereinafter, 43. The separator roller 43 sharply changes the direction in which the belt 44 runs, thereby separating the sheet 10 from the belt 44 on the basis of curvature. A guide roller 48 presses the portion of the belt 44 between the separator roller 43 and the support roller 41, which faces the belt cleaning unit 49, inward so as to increase the change in the moving direction of the belt 44. The belt 44 is driven by the support roller or drive roller 42. The heat roller 45 and back-up member 46 soften the toner deposited on the paper 10 while causing the image surface of the sheet 10 to closely contact the surface of the belt 44.

Because the masses of toner support the surface of the sheet 10, it is likely that the solitary toner particles fail to closely contact the belt 44 and, as a result, remain on the sheet 10, as stated earlier. To enhance the close contact of the solitary particles with the belt 44, the present invention uses the heat block 46*a,* FIG. 10, having a plurality of projections at the nip or uses the drive roller 42 as moving means. In this condition, the sheet 10 is passed through the toner separating unit 40 a plurality of times, as will be described specifically later.

The belt cleaning device 49 has a rotatable brush roller 50 for scraping off the toner from the belt 44. A pad 51 is held in contact with the belt 44 at a position downstream of the brush roller 50 in the direction of movement of the belt 44. The pad 51 removes the toner from the belt 44 by scrubbing the belt 44. The toner removed from the belt 44 is collected in a casing 52.

Further, in the toner separating unit 41, a conveyor roller pair 53 conveys the sheet 10 coming out of the liquid applying unit 30 into the nip between the heat roller 45 and the back-up member 46. An upper and a lower guide member 54 cooperate to guide the sheet 10 separated from the belt 44 by the separator roller 43 toward the drying unit 60. The separator roller 43 will also be described specifically later.

The drying unit 60 dries the sheet 10 such that the sheet 10 retains the liquid 31 in an amount which is, for example, less than 10% of its own weight. The unit 60 has a heat drum 61 made of, e.g., aluminum and having a lamp 61' therein. A belt 63 is passed over a plurality of support rollers 62 and movable while wrapping around the heat drum 61 over a preselected angle. One of the support rollers 62 plans the role of a tension roller. The belt 63 is implemented by a heat-resistant and air-permeable material, e.g., canvas, cotton, or Tetron. An upper and a lower guide member 64 guide the sheet 10 coming out of the region where the drum 61 and belt 63 contact each other. An outlet roller pair 65 drives the sheet 10 from the guide members 64 onto a tray included in the tray unit 70.

In operation, when the sheet 10 from the sheet feed unit 20 is introduced into the liquid applying unit 30, the unit 30 applies the parting liquid 31 evenly over the entire image surface of the sheet 10 on which a toner image is carried. Then, the sheet 10 is conveyed into the toner separating unit 40. The unit 40 softens the toner deposited on the sheet 10 with the heat roller 45 and back-up member 46. As a result, the toner softened on the sheet 10 adheres to the surface of the belt 44. When the sheet 10 is separated from the belt 44 by the separator roller 43, the toner is transferred from the sheet 10 to the belt 44. Subsequently, the sheet 10 is dried by the drying unit 61 and then driven out to the tray unit 70.

As stated above, the liquid applied to the sheet 10 penetrates into the interface between the paper 10 and the toner and thereby causes the toner to be separated from the sheet 10. This successfully removes the toner from the sheet 10 without damaging the fibers of the sheet 10.

Referring FIGS. 1A, 1B, 2, 3 and 4, specific configurations of the toner separating unit 40 representative of embodiments of the present invention will be described which prevent the toner, particularly solitary toner particles, from remaining on the sheet 10.

Figure 1A:
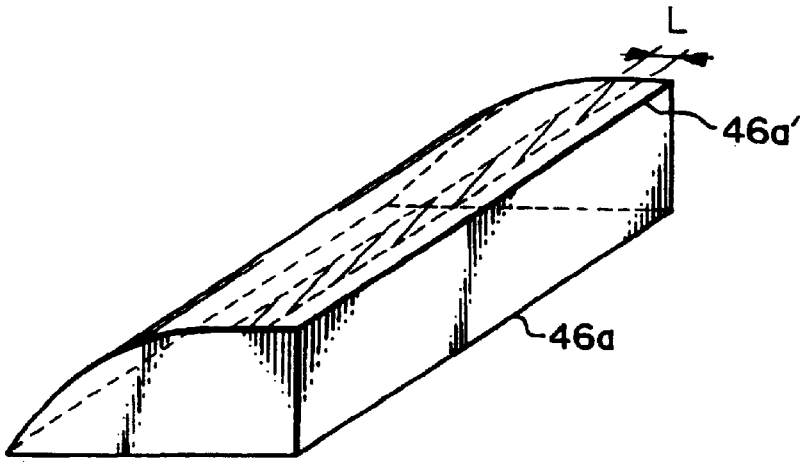
FIG. 1A is a perspective view showing a specific configuration of a heat block representative of an embodiment of the present invention.
Figure 1B:
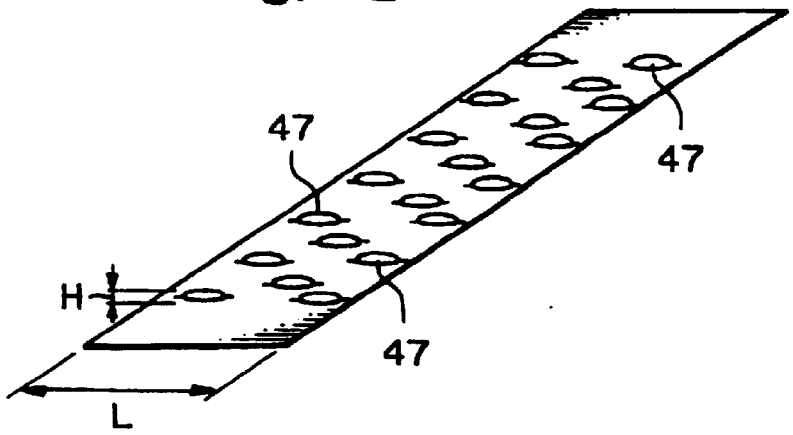
FIG. 1B is an enlarged perspective view of a nip particular to the heat block.

FIGS. 1A and 1B show a specific configuration of the heat block 46*a* representative of the toner separator unit 40. This unit 40 is identical with the unit 40 shown in FIG. 9 except for the heat block 46*a*. As shown, the block 46*a* has a plurality of projections 47 in the nip or pressing portion L thereof. The downstream corner 46'*a* of the block 46*a* serves to separate the sheet 10 from the belt 44. Specifically, as shown in FIG. 1B in an enlarged view, a plurality of arrays of projections 47 are formed on the surface of the block 46*a* that faces the image surface of the sheet 10. Let this surface of the block 46*a* be referred to as a front hereinafter. The arrays of projections 47 are spaced from each other in the direction of sheet transport, and each extends perpendicularly to the direction of sheet transport. Further, the arrays are arranged in a zigzag configuration such that the projections 47 of nearby arrays are not aligned in the direction of sheet transport. The projections 47 are 10 microns to several hundreds of microns high each (H). In this configuration, while the sheet 10 is passed through the nip L, the projections 47 raise the portions of the front of the belt 44 corresponding to the portions of the rear of the belt 44 contacting the projections 47 toward the image surface of the sheet 10 a plurality of times.

Figure 3:
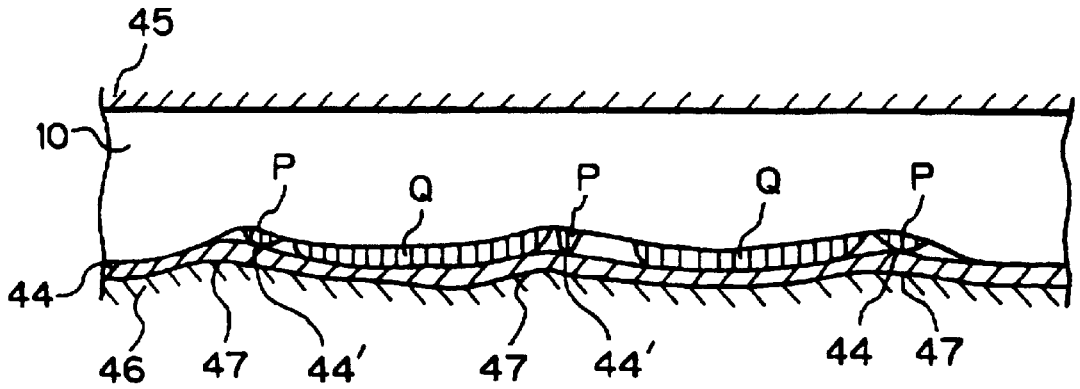
FIG. 3 is a sketch demonstrating how solitary toner particles contact a belt in any of the configurations of FIGS. 1 and 1B and 2.

More specifically, as shown in FIG. 3, the sheet 10 is passed through the nip L, which is several millimeters wide, together with the belt 44. At this instant, the projections 47 raise the above-mentioned portions of the belt 44 toward the image surface of the sheet 10 a plurality of items. Hence, despite that the solitary toner particles P exist in the vicinity of the relatively thick and large masses of toner Q, they are successfully brought into contact with the portions 44' of the front of the belt 44 raised by the projections 47. Subsequently, the toner particles are separated from the sheet 10 when the sheet 10 is separated from the belt 44 around the corner 46'*a* of the block 46*a*. As a result, the masses Q, particularly solitary particles P, are prevented from remaining on the sheet 10. It is noteworthy that the projections 47 have no influence on the pressure distribution at the nip L. The number of projections 47 is open to choice.

Figure 2:
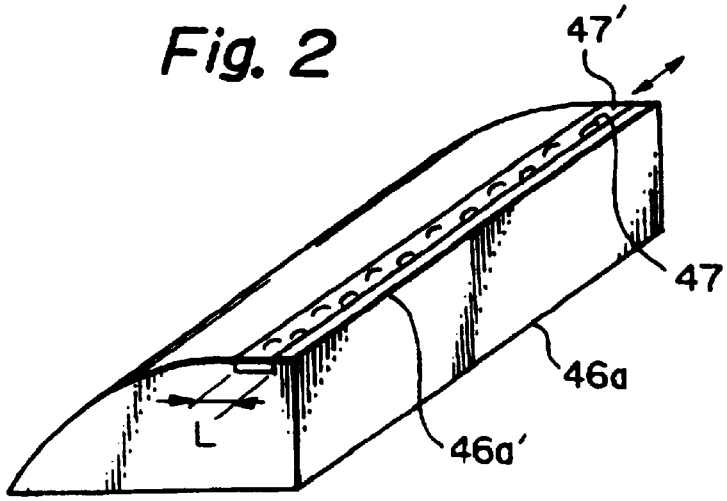
FIG. 2 is a perspective view showing another specific configuration of the heat block.

FIG. 2 shows another specific configuration of the heat block 46*a*. The toner separating unit 40 with the block 46*a* is identical with the unit 40 of FIG. 9 except for the block 46*a*. As shown, the projections 47 are formed on a single movable member 47. The member 47' is positioned at the nip L defined on the front of the block 46*a* and movable in a reciprocating motion perpendicularly to the direction of sheet transport. A plurality of arrays of projections 47 are formed on the front of the block 46*a* that faces the image surface of the sheet 10. The arrays of projections 47 are spaced from each other in the direction of sheet transport, and each extends perpendicularly to the direction of sheet transport. Further, the arrays are arranged in a zigzag configuration such that the projections 47 of nearby arrays are not aligned in the direction of sheet transport. The projections 47 are 10 microns to several hundreds of microns high each.

When the movable member 47' is moved back and forth in the direction perpendicular to the direction of sheet transport, the projections 47 are moved in the same direction. In this condition, while the sheet 10 is passed through the nip L, the front of the belt 44 is raised by the projections 47 widthwise toward the image surface of the sheet 10. This causes the belt 44 to contact the sheet 10 over a broader area than when the projections 47 are not movable. As a result, the solitary particles P contact the belt 44 more frequently than in the configuration of FIGS. 1A and 1B. Hence, the masses Q, particularly solitary particles P, are prevented from remaining on the sheet 10.

Again, the projections 47 have no influence on the pressure distribution at the nip L. While the speed at which the member 47' moves is open to choice, it should preferably be selected in consideration of the amount of toner to deposit on the sheet 10 and how many times the belt 44 is to be raised toward the sheet 10.

Figure 4:
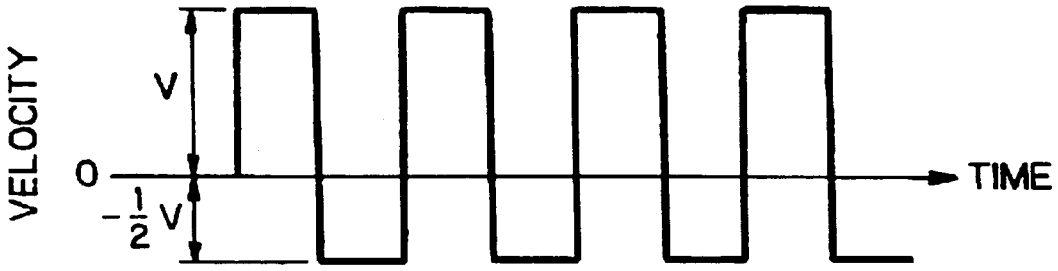
FIG. 4 is a graph representative of a specific drive pattern for driving a drive roller included in a toner separator unit.

Hereinafter will be described another alternative embodiment of the present invention including the toner separator unit 40 which has the drive roller 42 and back-up member or roller 46. The unit 40 is identical with the unit 40 shown in FIG. 9 except that the drive roller 42 is reversible. The drive roller 42 is reversibly driven by, e.g., a reversible motor. FIG. 4 shows a specific velocity pattern for driving the drive roller 42. With the velocity pattern of FIG. 4, the drive roller 42 causes a single sheet 10 to move back and forth via the nip a plurality of times, as follows. First, the roller 42 is driven forward to move the sheet 10 past the nip at a velocity of V until the sheet 10 has been separated from the belt 44 by the separator roller 43 except for the trailing edge portion thereof. Then, the roller 42 is reversed to return the sheet 10 toward the nip at a velocity of V/2. After the sheet 10 has moved away from the nip, the roller 42 is again rotated forward to drive the sheet 10 toward the separator roller 43 at the velocity of V. In the illustrative embodiment, the roller 42 causes the sheet 10 to move via the nip four consecutive times.

Assume that when the sheet 10 partly separated from the belt 44 by the separator roller 43 is returned to and passed through the nip in the reverse direction, it again contacts the belt 44 in exactly the same position as during the forward movement. Then, it is likely that the solitary particles P failed to contact the belt 44 last time due to the masses Q again fail to contact it. In the illustrative embodiment, when the sheet held in contact with the belt 44 is partly separated by the separator roller 43, it is in a contracted condition because water has been evaporated by the heat applied thereto at the nip. As a result, when the sheet 10 is returned to the nip by the roller 43, the positional relation between the sheet 10 and the belt 44 is different from the previous relation. This prevents the sheet 10 from contacting the belt 44 in the same position as before. It follows that the solitary particles P failed to contact the belt 44 last time possibly contact it at a different position when the sheet 10 is again passed through the nip.

When the sheet 10 is separated from the belt 44 around the separator roller 43, the solitary particles P adhered to the belt 44 are separated from the sheet 10. In this manner, the particles P contact the belt 44 more frequency. This prevents the masses Q, particularly solitary particles P, from remaining on the sheet 10.

Because the sheet 10 contains water even after it has been passed through the nip, the masses Q and solitary particles P are prevented from being again fixed on the sheet 10 despite the return of the sheet 10. It is to be noted that the velocity pattern shown in FIG. 4 is only illustrative, and that the number of items of separation by the separator roller 43 and the number of times of reciprocating movement are open to choice.

If desired, the heat block 46*a* shown in FIGS. 1A and 1B or FIG. 2 may be combined with the reversible drive roller 42. In this combination, the solitary particles P contact the surface portions of the belt 44 raised by the projections 47 toward the image surface of the sheet 10. In addition, the particles P failed to contact the belt 44 last time are allowed to contact it when the sheet 10 is moved back and forth via the nip a plurality of times. This successfully increases the number of times that the particles P contact the belt 44. While the sheet 10 has been described as being partly separated from the belt 44 before its return toward the nip, the drive roller 42 may be so controlled as to fully separate the sheet 10 from the belt 44, in which case returning means will be used to return the separated sheet 10 and belt 44 toward the nip.

Figure 12:
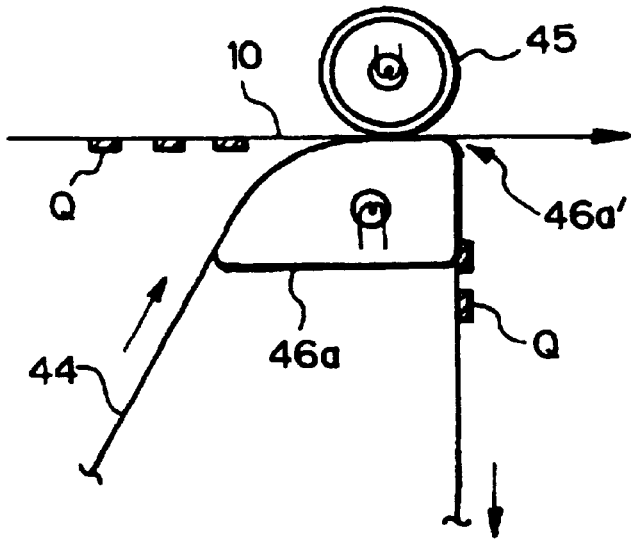
Fig. 12 PRIOR ART
FIG. 12 is a section of a conventional toner separator unit.

In the foregoing embodiments, the sheet 10 moved away from the nip is separated from the belt 44 by curvature, i.e., the sharp change in the direction in which the belt 44 runs. However, when the adhesion acting between the sheet 10 and the belt 44 is intense, it is likely that they cannot be surely separated from each other. The separator roller 43 shown in FIG. 9 is capable of reducing friction between it and the belt 44 and, therefore, the load to act on the belt 44, compared to the corner 46'*a* of the heat block 46*a* shown in FIG. 12. However, because the curvature of the roller 43 is greater than that of the corner 46'*a,* the simple roller scheme lowers the separating ability, compared to the heat block scheme.

Figure 5A:
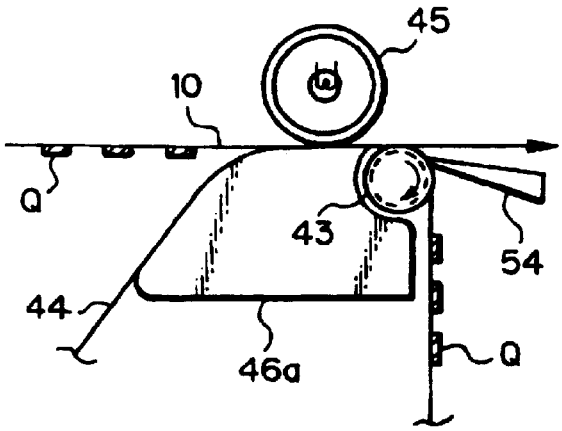
FIG. 5A is a section of a toner separating unit in accordance with the present invention.
Figure 5B:
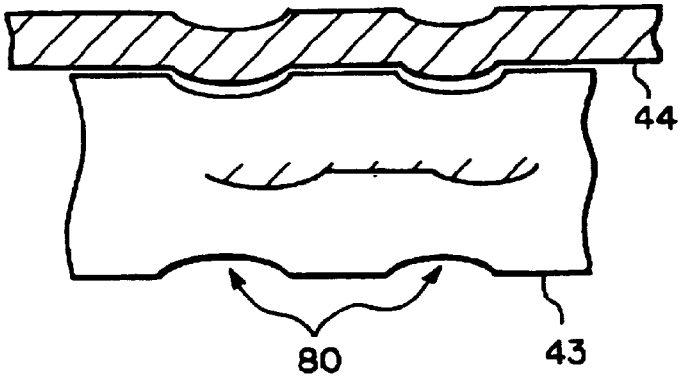
FIG. 5B is a section of a separator roller included in the unit of FIG. 5A.
Figure 5C:
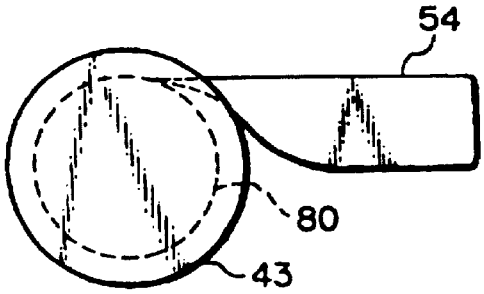
FIG. 5C shows a guide member contacting the separator roller of FIG. 5A.
Figure 6:
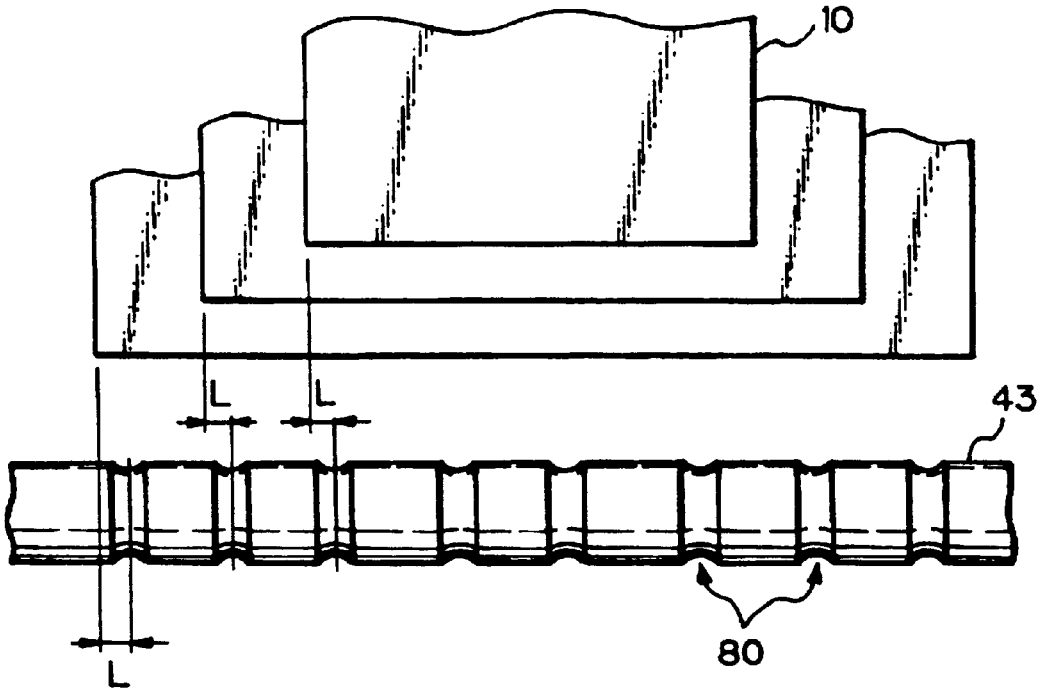
FIG. 6 shows a relation between sheet widths and grooves formed in the separator roller of FIG. 5B.

FIG. 5A shows a specific configuration of the toner separating unit 40 applicable to the device shown in FIGS. 9 or 10, and capable of surely obviating the defective separation mentioned above. FIG. 5B is a section along the axis of the separator roller 43. FIG. 5C shows a sheet guide 54 contacting the separator roller 43 and playing the role of a separator at the same time. As shown in FIG. 5B, a plurality of circumferential grooves 80 are formed in the separator roller 43 at predetermined intervals in the axial direction. Further, as shown in FIG. 5C, the sheet guide 54 is held in contact with the bottom of each groove 80 so as to physically separate the sheet 10 from the belt 44. As shown in FIG. 6, the grooves 80 are positioned in matching relation to various sheet sizes, i.e., such that the center of any one of the grooves 80 is spaced a predetermined distance L inward from one edge of the sheet of particular size in the widthwise direction. In practice, therefore, a plurality of sheet guides 54 are respectively received in the grooves 80 of the roller 43.

In the above configuration, at the position where the sheet is released from the force of the heat roller 45 and to be separated from the belt 44, it wraps around the grooves 80 of the roller 43. As a result, the belt 44 held under a preselected degree of tension is instantaneously deformed complementarily to the configuration of the grooves 80 and waves in the axial direction of the roller 43. On the other hand, the sheet 10 remains in contact with the belt 44 with the intermediary of the toner and maintains some elasticity although it is wet. This, coupled with the fact that the sheet 10 is free from tension, prevents the sheet 10 from following the instantaneous waving of the belt 44. Consequently, the sheet and the portions of the belt 44 corresponding to the grooves 80 are spaced apart from each other, or at least the adhesion acting therebetween is reduced. Hence, the separation of the sheet 10 to follow and relying on curvature is effected more desirably than when the belt 44 is not deformed along the grooves 80.

Moreover, the sheet guides 54 separate the sheet 10 from the belt 44 after the adhesion acting therebetween has been reduced. Hence, even if the guides 54 are not strongly pressed against the belt 44, the sheet 10 is surely separated from the belt 44. In addition, the load on the belt 44 and attributable to the guides 54 is reduced.

FIG. 6 shows a case wherein sheets 10 of different sizes are conveyed along a single center line in the widthwise direction. When sheets of different sizes are conveyed while being commonly positioned at a single edge, the distance between the nearby grooves 80 will be determined on the basis of the single edge.

Figure 7:
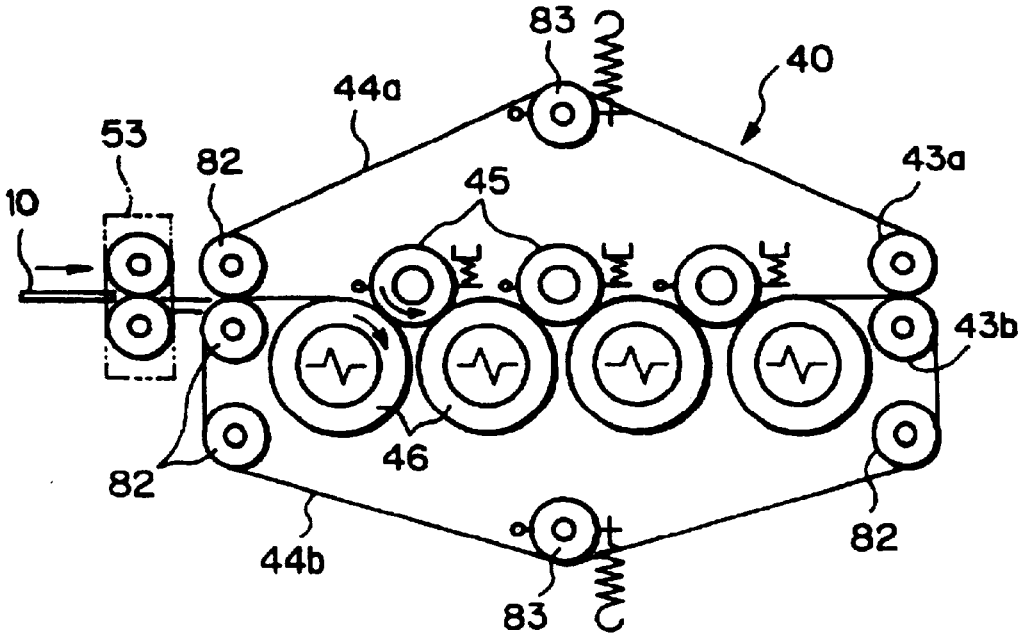
FIG. 7 is a section of another toner separating unit with which the present invention is practicable.

FIG. 7 shows an upper and a lower separator roller 43*a* and 43*b,* respectively, each being formed with the grooves 80. The rollers 43 and 43*b* are applied to a toner separating unit 40 of the type capable of removing toner from both sides of a sheet 10 at the same time. As shown, a sheet 10 carrying a toner image on both sides thereof is introduced into the unit 40 by a roller pair 53. Arranged in the unit 40 are an upper belt 44*a* and a lower belt 44*b*. The upper belt 44*a* is supported by a tension roller 83, a plurality of support rollers 82, and the upper separator roller 43*a*. Likewise, the lower belt 44*b* is supported by a tension roller 83, a plurality of support rollers 82, and the lower separator roller 43*b*. A plurality of heat rollers 45 and 46 define the nips of the upper and lower belts 44*a* and 44*b*. The sheet 10 is sequentially conveyed by the belts 44*a* and 44*b* while being bent in the form of a letter S. When the sheet 10 is passed through the nip between the separator rollers 43 and 43*b*, the toner is separated from both sides of the sheet 10. The adhesion acting between the sheet 10 and the belts 44*a* and 44*b* is reduced by the rollers 43*a* and 43*b*. As a result, the sheet 10 is separated from the belts 44*a* and 44*b* without wrapping around the roller 43*a* and 43*b*.

Figure 8A:
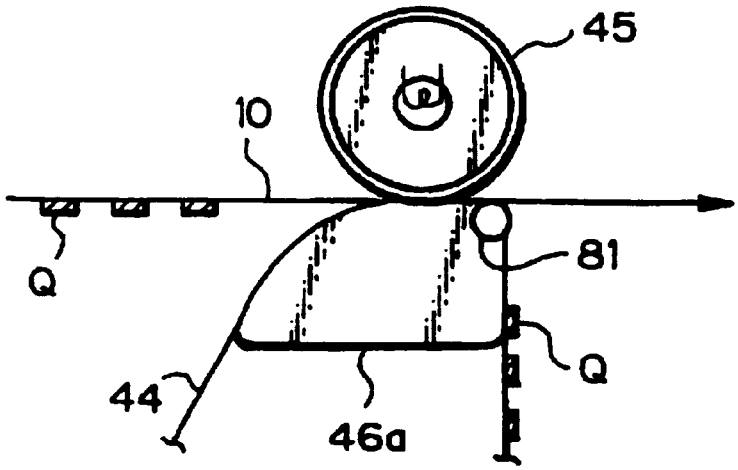
FIG. 8A is a section showing still another toner separating unit with which the present invention is practicable.
Figure 8B:
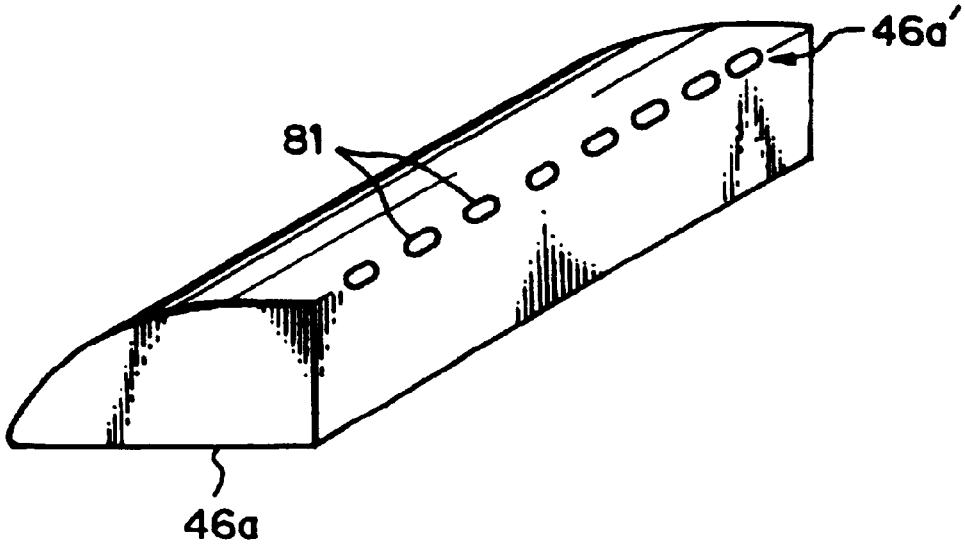
FIG. 8B is a perspective view of a heat block included in the unit of FIG. 8A.

FIG. 8A shows another implementation for obviating the defective sheet separation and applicable to the device shown in FIGS. 9 or 10. As best shown in FIG. 8B, a plurality of spherical members 81 having a small diameter are rollably buried in the corner 46'*a* of the heat block 46*a* and spaced in the lengthwise direction of the block 46*a*. The spherical members 81 also successfully cause the belt 44 and sheet 10 to be spaced apart from each other or at lease reduces the adhesion acting therebetween. The sheet separation to follow and relying on curvature can be effected more desirably than when the belt 44 does not deform along the spherical members 81. Particularly, the spherical members 81 can be provided with a smaller diameter than the separator rollers 43, further promoting the sheet separation relying on the curvature. In addition, because the spherical members 81 are rollable, friction between then and the belt 44 is eliminated while a motor for driving the belt 44 suffers from a minimum of load and can, therefore, be miniature.

In summary, it will be seen that the present invention provides a device for removing a substance deposited on a sheet and having various unprecedented advantages, as enumerated below.

(1) Projections are formed on a back-up member and located at portions on which the rear of a separating member slide. While a sheet is passed through a pressing portion in contact with the separating member, the projections raise the rear of the separating member toward the surface of the sheet carrying a substance. Hence, even solitary particles of the substance adjoining relatively thick and large masses of the substance can contact the front of the separating member. Hence, the solitary particles are prevented from remaining on the sheet.

(2) Projections are formed on a member movable back and forth in a direction perpendicular to an intended direction of sheet transport. While a sheet is passed through a pressing portion in contact with the separating member, the projections raise the rear of the separating member toward the surface of the sheet carrying the substance. This increases the area over which the separating member contacts the projections, compared to the case wherein the projections are not movable. As a result, the solitary particles are allowed to contact the separating member more frequently and are prevented from remaining on the sheet.

(3) Even when the solitary particles are left on the sheet separated from the separating member, they possible contact the separating member when the sheet is again brought into contact with the separating member. This increases the probability that the solitary particles contact the separating member, and thereby prevents them from remaining on the sheet.

(4) At a position where the sheet is released from the pressing portion and to be separated from the separating member, the sheet and separating member are spaced apart from each other between the projections, or at least adhesion acting therebetween is reduced. Hence, sheet separation to follow and relying on curvature can be effected more desirably than when the separating member is not deformable complementarily to the configuration of the projections.

(5) The decrease in the adhesion between the sheet and the separating member promotes the easy separation of the sheet. In addition, spherical rollable members are provided. Hence, even when the direction in which the separating member runs is sharply changed in the vertical direction relative to the direction of sheet transport in order to separate the sheet from the separating member on the basis of curvature, friction acting on the rear of the separating member is reduced when the member slides on a portion where the separation relying on curvature is to be effected. This protects the separating member from damage and insures desirable separation of the sheet from the separating member. Moreover, drive means for driving the separating member suffers from a minimum of load and can, therefore, be miniature. As a result, the entire device can be miniaturized.

(6) A separator roller is formed with circumferential grooves at preselected intervals in the axial direction thereof. The grooves cause the sheet and the separating member to be spaced apart from each other or at least reduce the adhesion acting therebetween. This further promotes the separation of the sheet and separating member, compared to the case wherein the grooves are absent.

(7) Sheet separator members are respectively received in the grooves of the separator roller and separate the sheet from the separating member with their tips. This further enhances the separation of the sheet and separating member, compared to the case wherein the separator members are absent. Because the grooves promote the separation of the sheet and separating member, it is not necessary for the separator members to be strongly pressed against the walls of the grooves. This also reduces the load to act on the drive means for driving the separating member and thereby miniaturizes it and, therefore, the entire device.

Various modifications will become possible for those skilled in the art after receiving the teachings of the present disclosure without departing from the scope thereof. For example, the present invention is practicable not only with recording sheets for use with an image forming apparatus, but also with sheets in the form of canvas, sliding partitions, and machine parts by way of example.

What is claimed is:

1. A method of removing a substance deposited on a surface of a sheet using a separating member, and a pressing member and a back-up member forming a nip therebetween, comprising the sequential steps of:

moving a sheet and the separating member in a first direction through the nip between the pressing member and the back-up member to separate a substance deposited on the surface of a sheet from the surface of the sheet;

separating at least a part of the sheet from the separating member; and moving the sheet and the separating member in a direction opposite the first direction through the nip to further separate the substance from the surface of the sheet.

2. The method of claim 1 including the further sequential steps of:

again separating at least a part of the sheet from the separating member; and again moving the sheet and the separating member in the first direction through the nip to further separate the substance from the surface of the sheet.

3. The method of claim 2 wherein each of said separating steps comprises separating substantially all of the sheet from the separating member.

4. The method of claim 1 wherein said separating step comprises separating substantially all of the sheet from the separating member.

* * * * *